US008892003B2

(12) United States Patent
Yoshida

(10) Patent No.: US 8,892,003 B2
(45) Date of Patent: Nov. 18, 2014

(54) IMAGE FORMING APPARATUS

(71) Applicant: Canon Kabushiki Kaisha, Tokyo (JP)

(72) Inventor: Michihiro Yoshida, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/660,407

(22) Filed: Oct. 25, 2012

(65) Prior Publication Data

US 2013/0114974 A1 May 9, 2013

(30) Foreign Application Priority Data

Nov. 9, 2011 (JP) ..... 2011-245895

(51) Int. Cl.
*G03G 21/00* (2006.01)

(52) U.S. Cl.
CPC ..... *G03G 21/0047* (2013.01)
USPC ..... 399/129; 399/149; 399/359

(58) Field of Classification Search
USPC ..... 399/50, 53, 54, 66, 127, 128, 149, 270, 399/274, 296, 354, 358–359
See application file for complete search history.

(56) References Cited

U.S. PATENT DOCUMENTS

| | | | | |
|---|---|---|---|---|
| 5,282,007 | A * | 1/1994 | Oshiumi | 399/150 |
| 6,064,837 | A * | 5/2000 | Hashimoto et al. | 399/50 |
| 7,058,326 | B2 * | 6/2006 | Toyama | 399/50 |
| 7,596,331 | B2 * | 9/2009 | Kinokuni | 399/50 |
| 7,831,159 | B2 | 11/2010 | Ishida | |
| 2008/0285993 | A1 | 11/2008 | Ishida | |
| 2011/0188881 | A1 * | 8/2011 | Akizuki et al. | 399/99 |

FOREIGN PATENT DOCUMENTS

| | | | |
|---|---|---|---|
| JP | 2002-148894 | A | 5/2002 |
| JP | 2003-255676 | A | 9/2003 |
| JP | 3884982 | B2 | 2/2007 |
| JP | 4019626 | B2 | 12/2007 |
| JP | 2008-145522 | A | 6/2008 |

* cited by examiner

*Primary Examiner* — Clayton E LaBalle
*Assistant Examiner* — Ruifeng Pu
(74) *Attorney, Agent, or Firm* — Fitzpatrick, Cella, Harper & Scinto

(57) ABSTRACT

An image forming apparatus 100 includes: a common voltage-applying unit 8 that applies a voltage to charging-assistant members 7Y, 7M, and 7C of a plurality of image forming portions PY, PM, and PC; and a control unit 110, at the start of applying a voltage to the charging-assistant members of the plurality of image forming portions by the voltage-applying unit 8, switches the absolute value of the applied voltage from a smaller first value to a larger second value when images are formed by the plurality of image forming portions.

2 Claims, 6 Drawing Sheets

*FIG. 6*

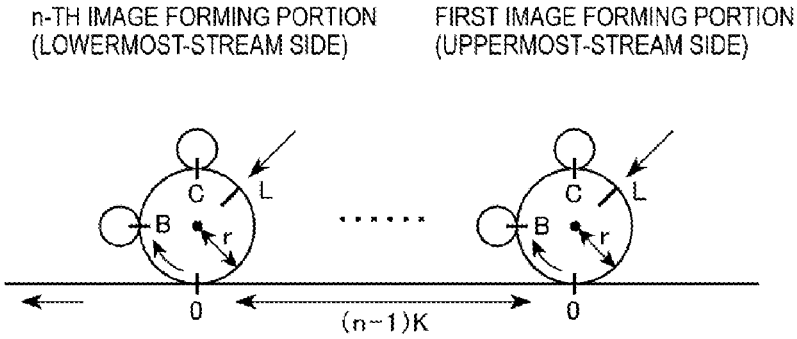

$$\frac{(n-1)K}{P} - \frac{(Cn-Bn)}{P} < BT2 < x + \frac{2\pi r - L1 + B1}{P}$$

r: RADIUS OF PHOTOCONDUCTIVE DRUM

B: DISTANCE FROM TRANSFER POSITION TO CHARGING-ASSISTANT POSITION

C: DISTANCE FROM TRANSFER POSITION TO CHARGING POSITION

L: DISTANCE FROM TRANSFER POSITION TO EXPOSING POSITION

K: DISTANCE BETWEEN IMAGE FORMING PORTIONS

P: PROCESS SPEED

BT2: TIME OF SETTING CHARGING-ASSISTANT VOLTAGE TO HIGH VOLTAGE WHEN FORMING IMAGE x: IMAGE EXPOSURE START TIME (CHARGING-APPLYING TIME OF FIRST IMAGE FORMING PORTION IS SET TO BE 0)

IMAGE FORMING APPARATUS

BACKGROUND OF THE INVENTION

1. Field of the Invention

The present invention relates to an image forming apparatus using an electrophotographic system of a copying machine, a laser printer, a facsimile, a printer, or a multifunction peripheral of them.

2. Description of the Related Art

In the related art, in an image forming apparatus using an electrophotographic system, a toner image is formed by developing an electrostatic image, which is formed on an electrophotographic photoreceptor (photoreceptor) by an exposure device, with a developing device. Further, the toner image is transferred to a recording material, for example, by an intermediate transfer member or a recording material conveying member, and then the toner is fixed on the recording material.

In the image forming apparatus using an electrophotographic system, when a toner image is electrically transferred to a transfer target member (such as a recording material on the intermediate transfer member or the recording material conveying member) from a transfer portion, transfer residual toner of about 1 to 10% is generated. The transfer residual toner passes through the transfer portion and turns around the photoreceptor. A method of using a cleaning device using cleaning blades is typically provided as a method of recovering the transfer residual toner from the photoreceptor. Further, there is also a method of reusing toner recovered in a developing device by providing a charging-assistant member and performing cleaning simultaneously with development with the developing device (see U.S. Patent Application Publication No. 2008/0285993 A1).

It is possible to easily perform cleaning simultaneously with development by applying a direct voltage to the charging-assistant member to recharge the transfer residual toner. Therefore, it is desirable that the voltage that is applied to the charging-assistant member be a voltage of a discharge threshold or more.

Further, the timing of applying a voltage to the charging-assistant member needs to satisfy the following conditions A and B.

The condition A is to apply a voltage to the charging-assistant member until the position of the photoreceptor charged by applying a voltage to a charging member comes to the position of the charging-assistant member. With the charged photoreceptor at the position of the charging-assistant member, when the voltage is not applied to the charging-assistant member, the potential (0 V) of the charging-assistant member becomes larger than the potential of the charged photoreceptor. Thus, positively-charged toner sticking to the charging-assistant member is abnormally discharged from the charging-assistant member to the photoreceptor and contaminates the charging member through the photoreceptor, which causes lack of potential or an image defect due to fog.

The condition B is to apply a voltage to the charging member until the photoreceptor charged by the charging-assistant member comes to the position of the charging member. When the potential (for example, −400 V) of the photoreceptor charged by the charging-assistant member reaches (development potential of 0 V of) the developing portion, the potential difference (Vback) between the potential of the photoreceptor and the development potential at the development position becomes abnormal, such that carriers stick or fog of the toner is generated, thereby causing an image defect. The development potential is the potential of a direct-current component of a development voltage that is applied to a developer bearing member of the developing device.

For the reasons described above, it is necessary to apply a voltage to the charging-assistant member such that the conditions A and B are satisfied.

As the image forming apparatus having an electrophotographic system, there is a tandem type of an image forming apparatus including four image forming portions that form an image of four colors, for example, of yellow (Y), magenta (M), cyan (C), and black (K), respectively. In this case, the space for disposing a high-voltage power supply that is a voltage-applying unit or a transformer is downsized and the cost decreases as compared with when a high-voltage power supply or a transformer is individually provided, by sharing the voltage-applying unit which applies a voltage to the charging-assistant members of a plurality of image forming portions (see Japanese Patent Laid-Open No. 2002-148894).

However, when the voltage-applying unit which applies a voltage to the charging-assistant members in the plurality of image forming portions is shared, the timings of applying a voltage to the charging-assistant members in all the image forming portions become the same.

Therefore, for example, when the timing of applying a voltage to the charging-assistant member is set such that the conditions A and B are satisfied in the image forming portion at the uppermost-stream side, the following problems are generated. That is, in this case, it is necessary to greatly increase the time of applying a voltage to the charging member in order to satisfy the conditions A and B for the timing of applying a voltage in the image forming portion at the lowermost-stream side. That is, a voltage starts to be applied to the charging member of the image forming portion at the lowermost-stream side in accordance with the charging timing at the uppermost-stream side. As a result, in the image forming portion at the lowermost-stream side, cutting of the photoreceptor or fusion bonding (filming) of the toner is made worse, which causes a longitudinal line-shaped defect in the image and reduces the durability life of the photoreceptor.

SUMMARY OF THE INVENTION

Thus, it is desirable to provide an image forming apparatus that can suppress generation of an image defect due to an increase in time of applying a charging voltage in each image forming portion even if a voltage-applying unit which applies a voltage to charging-assistant members of a plurality of image forming portions.

An image forming apparatus that achieves the above-described object includes: a plurality of image forming portions each including a charging device that charges a surface of a photoreceptor, an exposure device that forms an electrostatic image by exposing the charged photoreceptor, a developing device that develops the electrostatic image formed on the photoreceptor using toner and restores transfer residual toner on the photoreceptor, a transfer device that transfers a toner image formed on the photoreceptor to a transfer target member, and a charging-assistant member that charges the toner on the photoreceptor at a downstream side of the transfer device and at an upstream side of the charging device in a rotational direction of the photoreceptor; a common power supply that applies a voltage to the charging-assistant members of the plurality of image forming portions; and a controller that, at start of applying a voltage to the charging-assistant members of the plurality of image forming portions by the common power supply, switches an absolute value of the applied voltage from a smaller first value to a larger second value at a predetermined timing when images are formed by the plurality of image forming portions.

Further features of the present invention will become apparent from the following description of exemplary embodiments with reference to the attached drawings.

BRIEF DESCRIPTION OF THE DRAWINGS

FIG. 6 is a diagram for describing conditions for a timing of switching a charging-assistant voltage.

DESCRIPTION OF THE EMBODIMENTS

Hereinafter, an image forming apparatus of the invention will be described in detail with reference to the drawings. However, the dimensions, materials, shapes, and relative arrangements of components described in the following embodiments should be appropriately changed in accordance with the configuration of an apparatus where the invention is applied or various conditions, and the scope of the invention is not limited to the following embodiments.

First Embodiment

1. Image Forming Apparatus

Figure 1:
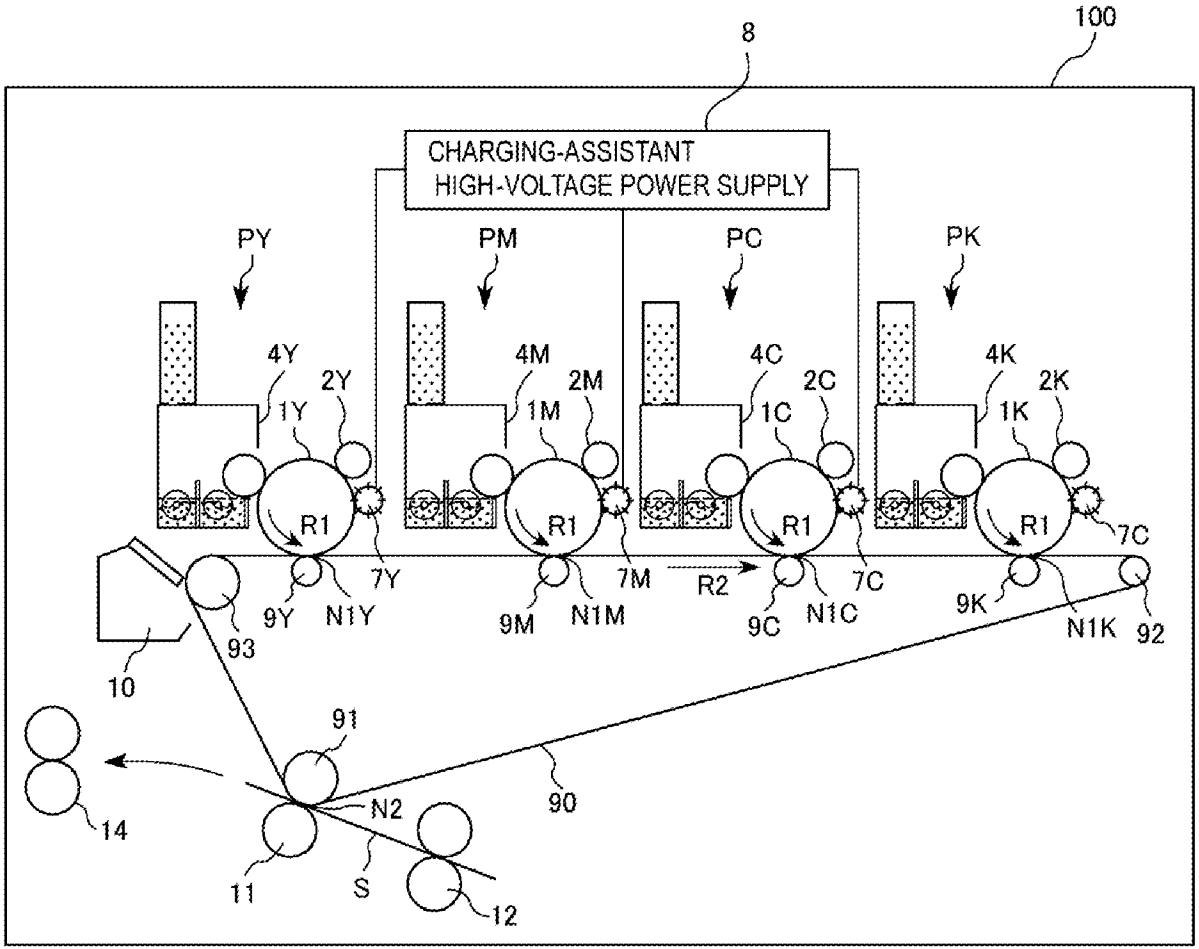
FIG. 1 is a diagram for describing the configuration of an image forming apparatus according to an embodiment of the invention.
Figure 2:
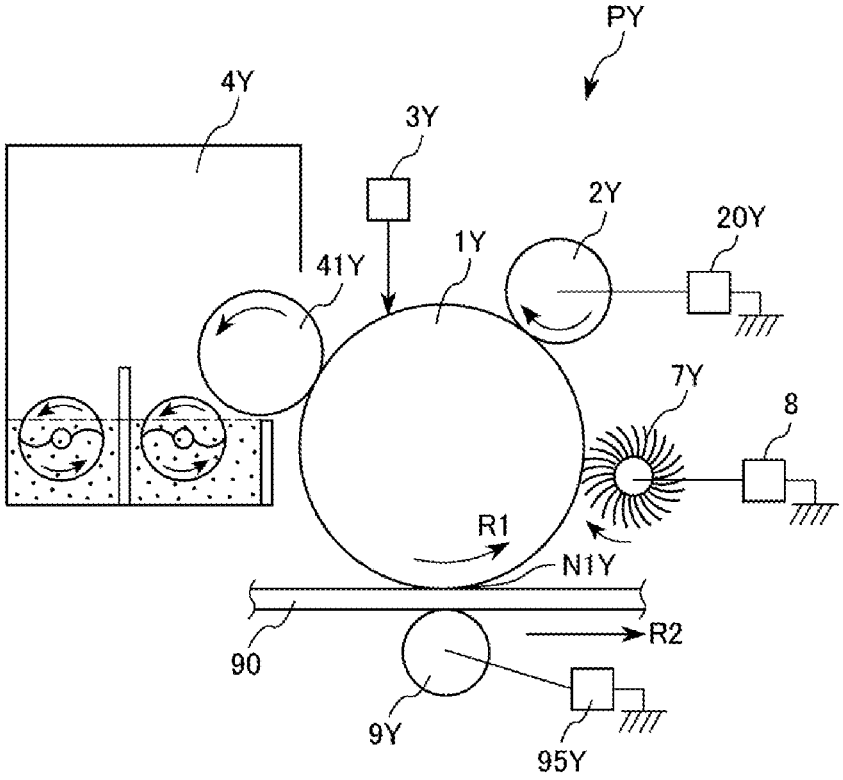
FIG. 2 is a diagram for describing the configuration of an image forming portion according to the embodiment of the invention.

FIG. 1 is a diagram for describing the configuration of an image forming apparatus. FIG. 2 is a diagram for describing the configuration of an image forming portion.

As illustrated in FIG. 1, an image forming apparatus 100 is a tandem type of intermediate transfer type full color printer in which yellow, magenta, cyan, and black image forming portions PY, PM, PC, and PK are arranged along an intermediate transfer belt 90.

Toner images colored with yellow, magenta, cyan, and black are formed on photoconductive drums 1Y, 1M, 1C, and 1K in the yellow, magenta, cyan, and black image forming portions PY, PM, PC, and PK, respectively, and are transferred onto the intermediate transfer belt 90 at each primary transfer portion N1. The distance from the upstream transfer position N1 to the downstream transfer position N1 of each color image forming portion (hereafter, referred to as a "transfer pitch) is 100 mm.

The full color toner image formed by overlapping the four color toner images is conveyed to a secondary transfer portion N2 by revolution of the intermediate transfer belt 90 and is secondarily transferred onto a recording material S. The recording materials S taken out from a recording material cassette (not illustrated) are separated one by one by a separating roller (not illustrated) and conveyed to registration rollers 12. The registration rollers 12 send the recording material S to the secondary transfer portion N2 at the timing of the toner image on the intermediate transfer belt 90. The recording material S with the full color toner image secondarily transferred by the secondary transfer portion N2 is heated and pressed by a fixing device 14 such that the image is fixed on the surface and then is discharged to the outside of the main body of the device.

The intermediate transfer belt 90 that is an intermediate transfer member as a transfer target member is held and supported by a driving roller 93, a tension roller 92, and a secondary transfer counter roller 91, and is driven by the driving roller 93 to revolve in the direction of an arrow R2 as illustrated in the drawing at a predetermined process speed. The secondary transfer roller 11 forms the secondary transfer portion N2 by being pressed on the intermediate transfer belt 90 with the inner side supported by the secondary transfer counter roller 91.

A belt cleaning device 10 causes a cleaning blade to make contact with the intermediate transfer belt 90, removes and restores the transfer residual toner on the intermediate transfer belt 90, which passes the secondary transfer portion N2 without being transferred onto the recording material S.

The image forming portions PY, PM, PC, and PK have the same configuration, except that the colors of the toner used in developing devices 4Y, 4M, 4C, and 4K are different. Hereinafter, the yellow image forming portion PY is described, and the magenta, cyan, and black image forming portions PM, PC, and PK are described, with the last symbol Y of the reference character, which is given to the element of the yellow image forming portion PY, changed to M, C, and K. Further, the postfixes Y, M, C, and K are omitted when the image forming portions are generally described without discriminating the elements thereof.

2. Image Forming Portion

As illustrated in FIG. 2, in the image forming portion PY, a charging roller 2Y, an exposure device 3Y, a developing device 4Y, a primary transfer roller 9Y, and a charging-assistant brush 7Y are disposed around a photoconductive drum 1Y. The photoconductive drum 1Y, which is a cylindrical image bearing member, includes a photosensitive layer formed on the outer circumferential surface of the aluminum cylinder having a diameter of 30 mm and rotates at a process speed of 120 mm/sec.

The charging roller 2Y that is a charging device is driven to rotate in contact with the photoconductive drum 1Y. Further, a charging voltage (charging bias), which is an oscillation voltage obtained by superimposing a direct voltage (charging DC voltage) and an alternating voltage (charging AC voltage), is applied to the charging roller 2Y from a charging high-voltage power supply 20Y as a charging voltage applying unit. Accordingly, the charging roller 2Y charges the surface of the photosensitive drum 1Y with uniform negative dark potential VD. The charging position by the charging roller 2Y is at an imaging distance (distance along the surface of the photosensitive drum) from the primary transfer position N1Y in the rotational direction of the photoconductive drum 1Y.

The exposure device (laser scanner) 3Y that is an exposing unit records an electrostatic image (electrostatic latent image) onto the charged photoconductive drum 1Y by scanning a laser beam obtained by ON/OFF-modulating an image signal developing the yellow image, with a rotary mirror. In the exposed portion, the dark potential VD is discharged and decreased to a bright potential VL. The exposing position by the exposure device 3Y is at an imaging distance of 45 mm from the primary transfer position N1Y in the rotational direction of the photoconductive drum 1Y.

The developing device 4Y that is a developing unit forms a toner image on the photoconductive drum 1Y by developing the electrostatic image formed on the photoconductive drum 1Y with a developer containing toner and a carrier. In the present embodiment, the developing device 4Y uses a two-component developer containing toner (nonmagnetic toner particle) and a carrier (magnetic carrier particle) as a developer. The developing device 4Y has a rotatable developing sleeve 41Y as a developer bearing member such that a part thereof is exposed from the opening which faces the photoconductive drum 1Y of a developing container receiving the developer. The developer is borne onto the developing sleeve 41Y and conveyed to the developing portion (developing device) that is an opposite portion to the photoconductive drum 1Y, thereby supplying toner in the developer to the photoconductive drum 1Y. A developing voltage (developing bias), which is an oscillation voltage obtained by superimposing a direct voltage (developing DC voltage) and an alternating voltage (developing AC voltage), is applied to the developing sleeve 41Y from a developing high-voltage power supply (not illustrated) serving as a developing voltage-applying unit. In the present embodiment, the toner image is formed by combination of image exposure and reverse development. That is, the electrostatic latent image is developed by attaching the toner, which is charged with the same polarity (normal charging polarity) as the charging polarity (negative-polarity in the present embodiment) of the photoconductive drum 1Y, to the exposed portion where the absolute value of the potential is decreased by exposing after being uniformly charged.

The primary transfer roller 9Y that is a primary transfer portion forms the primary transfer portion N1Y between the photoconductive drum 1Y and the intermediate transfer belt 90 by pressing the inner side of the intermediate transfer belt 90. A transfer voltage (transfer bias), which is a direct voltage (transfer DC voltage) having a polarity opposite to the normal charging polarity of the toner, is applied to the primary transfer roller 9Y by a transfer high-voltage power supply 95 serving as a transfer voltage-applying unit. Accordingly, a toner image with a negative-polarity borne by the photoconductive drum 1Y is primarily transferred to the intermediate transfer belt 90. In the present embodiment, the transfer current when a common image is formed is set to 20 μA.

The charging-assistant brush 7Y that is a charging-assistant member (toner charging portion) charges the transfer residual toner, which has passed the primary transfer portion N1Y without being transferred to the intermediate transfer belt 90, with negative potential while diffusing the toner onto the surface of the photoconductive drum 1Y. As described below in detail, a charging-assistant voltage (charging-assistant bias), which is a direct voltage (charging-assistant DC voltage) having the same polarity as the normal charging polarity of the toner, is applied to the charging-assistant brush 7Y by a charging-assistant high-voltage power supply 8 serving as a charging-assistant voltage-applying unit. As being charged with the negative potential, the transfer residual toner reaches the developing device 4Y without sticking to the charging roller 2Y. Further, the transfer residual toner can be restored and reused in the developing device 4Y. A system for reusing transfer residual toner in a developing device, not restoring the transfer residual toner by a cleaning blade, as described above, is called a "cleaner-less system". The charging-assistant position by the charging-assistant brush 7Y is at an imaging distance of 30 mm from the primary transfer position N1Y in the rotational direction of the photoconductive drum 1Y.

For convenience, it is assumed that the center of the contact portion between the charging roller 2 and the photoconductive drum 1 in the rotational direction of the photoconductive drum 1 is the charging position. Further, it is assumed that the position where the exposure device performs irradiating with a beam in the rotational direction of the photoconductive drum 1 is the exposing position. Further, it is assumed that the center of the contact portion between the primary transfer roller 9 and the photoconductive drum 1, with the intermediate transfer belt 90 interposed therebetween, in the rotational direction of the photoconductive drum 1 is the primary transfer position (transfer position). Further, it is assumed that the center of the contact portion between the charging-assistant brush 7 and the photoconductive drum in the rotational direction of the photoconductive drum 1 is the charging-assistant position.

3. Controller

Figure 3:
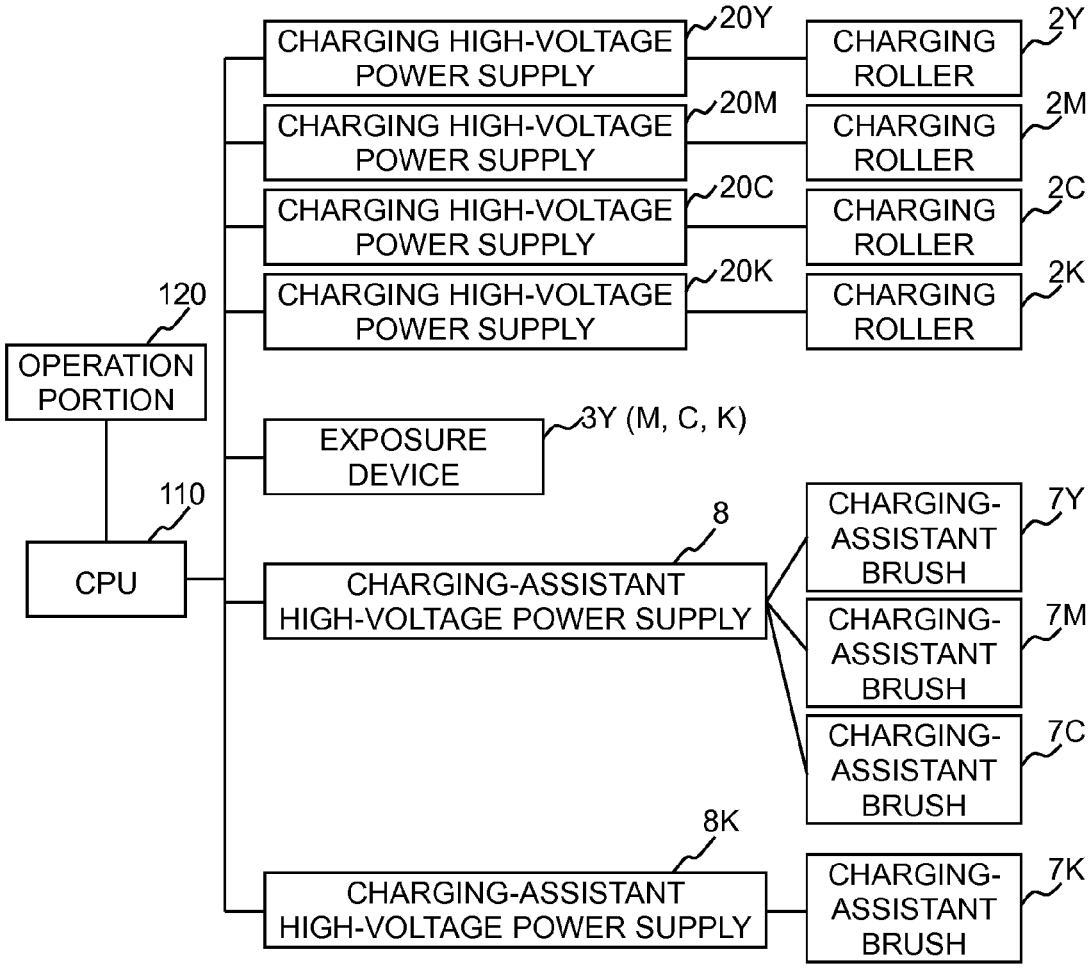
FIG. 3 is a block diagram illustrating a control system of an image forming apparatus according to the embodiment of the invention.

FIG. 3 is a block diagram illustrating a controller of the image forming apparatus 100. A CPU 110 generally controls the operation of the image forming apparatus 100 as a control unit. The CPU 110 controls the operation of each portion of the image forming apparatus 100 in accordance with a program or data stored in a built-in or connected storage unit (electronic memory and the like).

In the present embodiment, a charging-assistant high-voltage power supply 8, which is a charging-assistant voltage-applying unit for the yellow, magenta, and cyan image forming portions PY, PM, and PC, is shared. Therefore, it is possible to reduce the space for the high-voltage power supply and decrease the cost, as compared with a case in which individual high-voltage power supplies are provided. However, to share the voltage-applying unit, a component such as a transformer can be effectively shared.

Further, it is assumed that monochromic images are formed more than color images according to the present embodiment. Therefore, a charging-assistant high-voltage power supply 8K is disposed for the charging-assistant brush 7K of the black image forming portion PK, independent from the yellow, magenta, and cyan image forming portions PY, PM, and PC. However, the invention is not limited thereto, and for example, a charging-assistant high-voltage power supply may be shared by all the image forming portions PY, PM, PC, and PK.

4. Control Flow of Image Forming

First, control of a comparative example is described. Thereafter, control of the present embodiment is described in comparison to the control of the comparative example.

4-1. Description of Control of Comparative Example Using Timing Chart

Figure 4:
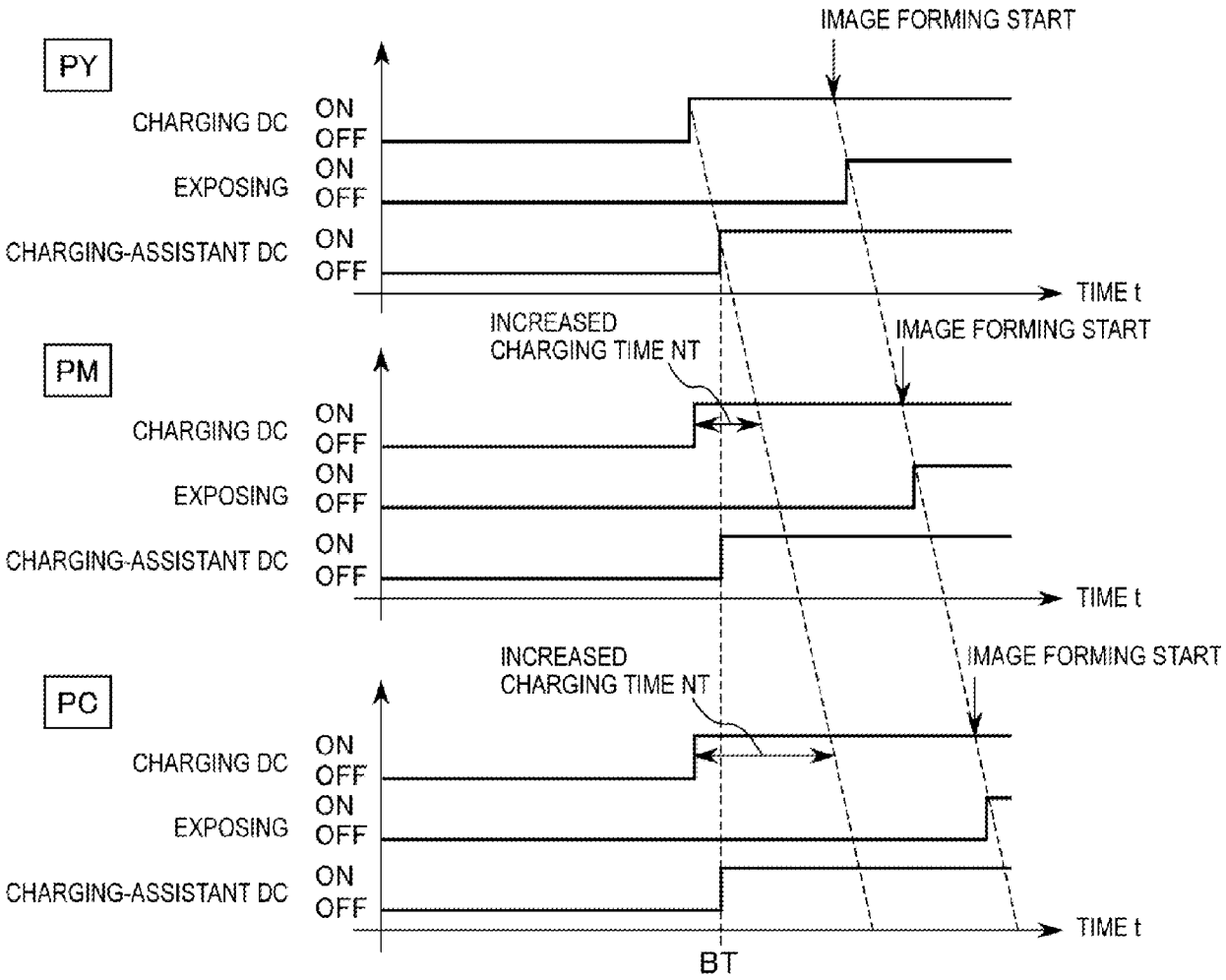
FIG. 4 is a chart illustrating a voltage applying sequence of charging, exposing, and charging assistance of a comparative example.

FIG. 4 is a timing chart illustrating control of a comparative example. For example, when an image forming signal (print start signal) is input from an operation portion 120 corresponding to a touch panel that is directly operated by a user, the CPU 110 starts processing as follows. First, the CPU 110 sequentially starts to apply a voltage to the charging roller 2Y of the yellow image forming portion PY, apply a voltage to the developing sleeve 41Y, drive the exposure device 3Y, apply a voltage to the primary transfer roller 9Y, and apply a voltage to the charging-assistant brush 7Y.

FIG. 4 illustrates a timing chart of applying a direct voltage (charging DC) that is applied to the charging roller 2Y, light emission from the exposure device 3Y, and a direct voltage (charging-assistant DC) that is applied to the charging-assistant brush 7Y, for the importance. The dotted lines in FIG. 4 indicate the timings when the surface of the photoconductive drum 1 that has been positioned at the charging roller 2 passes the position of the charging-assistant brush 7Y and the exposing position by the exposure device 3. However, the timings of applying a voltage to the developing sleeve 4Y and the primary transfer roller 9Y are close to the timing of applying a voltage to the charging roller 2Y and not illustrated, because the timing chart is complicated when the timings are illustrated.

The CPU 110 drives the photoconductive drum 1, such that a direct voltage of −700 V is applied from the charging high-voltage power supply 20*y* to the charging roller 2Y. Further, the CPU 110 controls the potential difference Vback between the potential of the photoconductive drum 1Y and the potential of the developing sleeve 41Y to keep constant by applying a direct voltage of −550 V to the developing sleeve 41Y, though not illustrated, at the timing of the charged photoconductive drum 1Y coming to the developing portion. The photoconductive drum 1Y is charged at least one round or more to stabilize the potential of the photoconductive drum 1Y. However, the charging is minimized in order to reduce the charging time as much as possible. Further, the CPU 110, though not illustrated, supplies a current of 20 μA to the primary transfer roller 9Y at the timing of the charged photoconductive drum 1Y coming to the position of the primary transfer roller 9Y. The potential of the photoconductive drum 1Y after primary charging is about −300 V on the surface of the photoconductive drum 1Y without toner thereon.

Next, the CPU 110 applies a direct voltage of −900 V to the charging-assistant brush 7Y from the charging-assistant high-voltage power supply 8. The voltage is a voltage that is sufficiently discharged in the direction from the charging-assistant brush 7Y to the photoconductive drum 1Y, even at the potential of −300 V of the photoconductive drum 1Y after primary charging. Discharging is necessary to sufficiently charge again the transfer residual toner.

The timing BT of applying a voltage to the charging-assistant brush 7Y is necessary to satisfy the following conditions A and B.

As the condition A, it is desirable to apply a voltage to the charging-assistant brush 7Y until the position of the charged photoconductive drum 1Y comes to the position of the charging-assistant brush 7Y. In more detail, it is desirable to apply a voltage to the charging-assistant brush 7Y until the position of the potential (−300 V) of the photoconductive drum 1Y that has passed the primary transfer roller 9Y after being charged comes to the position of the charging-assistant brush 7Y. This is the same even when the primary transfer roller 9Y does not perform transferring and the photoconductive drum 1Y is discharged to be minus.

That is, when the position of the charged photoconductive drum 1Y came to the position of the charging-assistant brush 7Y and the charging-assistant voltage is not applied to the charging-assistant brush 7Y, the potential (0 V) of the charging-assistant brush 7Y is larger than the potential (−300 V) of the charged photoconductive drum 1Y. Therefore, the toner having positive charge and sticking on the charging-assistant brush 7Y is abnormally discharged to the photoconductive drum 1 from the charging-assistant brush 7Y and contaminates the charging roller 2Y through the photoconductive drum 1Y. Accordingly, the potential of the photoconductive drum 1Y is insufficient or an image defect due to fog is generated by insufficient charging by the charging roller 2Y.

Further, as the condition B, it is desirable to apply a voltage to the charging roller 2Y until the position of the photoconductive drum 1Y charged by the charging-assistant brush 7Y where a voltage is applied comes to the position of the charging roller 2Y.

That is, the potential (−400 V) of the photoconductive drum 1Y charged by the charting-assistant brush 7Y reaches the position of the developing sleeve 41Y. Accordingly, the difference (Vback) between the potential (dark potential VD) of the photoconductive drum 1Y and the developing potential at the developing position becomes abnormal and carrier sticking or fog of the toner is generated, thereby causing an image defect.

The carrier sticking is a phenomenon that a carrier of a developer, which is not supposed to stick to a photoreceptor, sticks to the photoreceptor. Further, the fog is a phenomenon that toner sticks to a non-image area on a photoreceptor, where toner is not supposed to stick.

When the conditions A and B described above are satisfied and the potential of the photoconductive drum 1Y is stabilized after a voltage is applied to the charging-assistant brush 7Y, the CPU 110 starts exposing with the exposure device 3Y. This timing is called "image forming start" or "image exposing start". An instruction is given to the exposure device 3Y from the CPU 110 and exposing that corresponds to an image signal is performed.

Similar to the yellow image forming portion PY, the timing chart of the magenta image forming portion PM is described. The image forming timing is determined by the distance between the photoconductive drums of adjacent image forming portions in order to match yellow, magenta, and cyan toner images to each other on the intermediate transfer belt 90. Further, the timing BT of applying a voltage to the charging-assistant brush 7M or the voltage value applied to the charging-assistant brush 7M are the same for the yellow, magenta, and the cyan image forming portions PY, PM, and PC, such that they depend on those of the yellow image forming portion PY.

Therefore, it is necessary to advance the timing of applying a voltage to the charging roller 2M more than the ideal in order to satisfy the conditions A and B of the timing of applying a voltage to the charging-assistant brush 7M in the magenta image forming portion PM. The ideal is a timing obtained by adding a time determined by "distance between photoconductive drums" "process speed" of adjacent image forming portions, to the timing of applying a voltage to the charging roller 2Y of the yellow image forming portion PY. Accordingly, the charging time NT unnecessarily increases by "distance between adjacent photoconductive drums"÷"process speed".

Further, similar to the charging time, the timing of applying a voltage to the developing sleeve 41M of the magenta image forming portion PM disposed at the downstream side of the yellow image forming portion PY, which is the reference, is also advanced.

Therefore, deterioration of the developer is promoted. Accordingly, cutting or filming of the photoconductive drum becomes worse, thereby shortening the lifespan of the photoconductive drum. When the image forming apparatus 100 employs a process cartridge type, the life span of the process cartridge is also shortened. The process cartridge is detachably attached to the main body of the image forming apparatus by making a photoreceptor and at least one of a charging portion that is a process unit that operates to a photoreceptor, a developing unit, and a cleaning unit (or charging-assistant unit), integrally into a cartridge.

Similarly, the charging time NT increases as much as two image forming portions, in the cyan image forming portion PC. It has been known in the related art that, in a cleaner-less system, the image forming portion at the lowermost-stream side is also largely influenced by retransfer residual toner (toner retransferred to a photoreceptor from a transfer target member at the transfer position). Therefore, the influence of the unnecessarily increased charging time NT becomes more serious.

Accordingly, a voltage starts to be applied to the charging member of the image forming portion at the lowermost-stream side in accordance with the charging timing at the uppermost-stream side. As a result, in the image forming unit at the lowermost-stream side, cutting of the photoreceptor or fusion bonding (filming) of the toner is made worse, which causes an image defect of longitudinal lines and shortens the durability life of the photoreceptor.

4-2. Description of Present Embodiment Using Timing Chart

Figure 5:
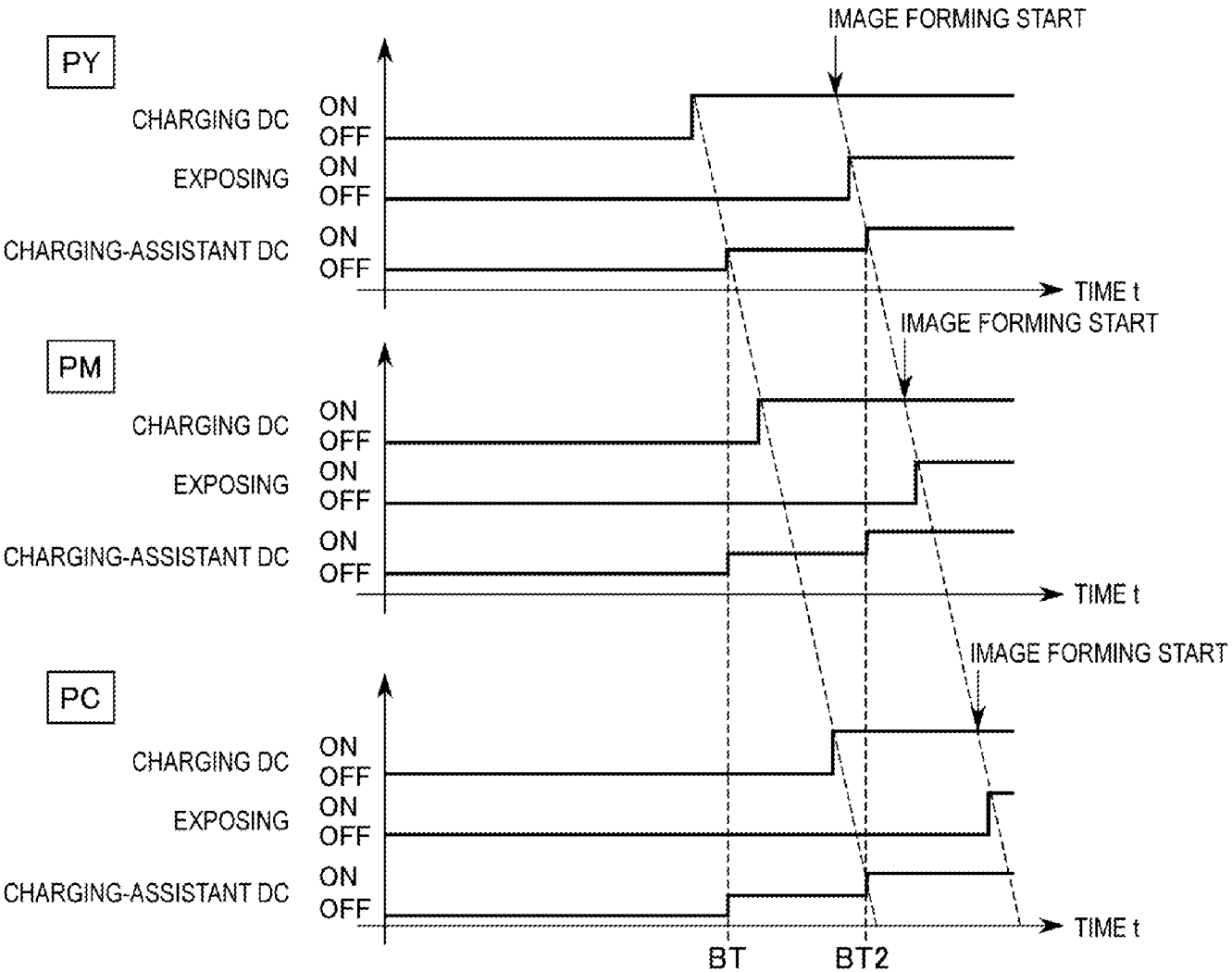
FIG. 5 is a chart illustrating a voltage applying sequence of charging, exposing, and charging assistance according to an embodiment of the invention.

Next, control that solves the above-described problem in the configuration of the present embodiment in which a power supply that applies a voltage to a plurality of charging-assistant members is shared is described. FIG. 5 is a timing chart illustrating the control.

According to the present embodiment, the value of the voltage applied to the charging-assistant brush is changed in two steps to remove or reduce the unnecessary charging time described above as less as possible.

Timing of applying charging DC, exposing, charging-assistant DC of the present embodiment are described with reference to FIG. 5. The dotted lines in FIG. 5, similar to FIG. 4, indicate the timings when the surface of the photoconductive drum 1 that has been positioned at the charging roller 2 passes the exposing position by the exposure device 3 and the position of the charging-assistant brush 7Y. Further, the same parts as those in the control of the comparative example illustrated in FIG. 4 are not described.

First, in the yellow image forming portion PY, the CPU 110 applies a voltage of −400 V as a charging-assistant voltage of the first step to the charging-assistant brush 7Y from the charging-assistant high-voltage power supply 8. The voltage is a voltage that is not discharged in the direction from the charging-assistant brush 7Y to the photoconductive drum 1Y, even at the potential of −300 V of the photoconductive drum 1Y after passing the primary transfer roller 9Y. Further, the timing BT of applying a voltage to the charging-assistant brush 7 satisfies the conditions A and B described above. That is, the value of the charging-assistant voltage of the first step (first value) is a value where the potential difference between the charging-assistant member and the photoreceptor is smaller than a discharge start voltage and the charging-assistant value of the second step (second value) is a value where the potential difference between the charging-assistant member and the photoreceptor is larger than the discharge start voltage.

Similar to the yellow image forming portion PY, the CPU 110 applies a voltage even to the magenta image forming portion PM. The timing of applying a voltage to the charging roller 2M in the magenta image forming portion PM, unlike the control of the related art, is set as the optimal condition where unnecessary "distance between adjacent photoconductive drums"÷"process speed" is removed or as small as possible. The timing BT of applying a voltage to the charging-assistant brush 7M depends on that in the yellow image forming portion PY. Accordingly, it is possible to satisfy the conditions A and B described above.

Here, the case when the control of the present embodiment, different from the control of the related art, can satisfy the condition B described above is described.

A voltage is applied to the charging-assistant brush 7M before the charging roller 2M. However, for the potential (0 V) of the photoconductive drum 1M, the charging-assistant voltage of the first step which is applied to the charging-assistant brush 7M is −400 V. Thus, the potential of the photoconductive drum 1M is almost not changed. This is because it is not discharged. Therefore, it is possible to sufficiently keep the voltage Vback even though the position of the photoconductive drum 1M that has passed the charging-assistant brush 7M reaches the developing position, so that it is possible to satisfy the condition B.

Further, the photoconductive drum 1M charged by applying a voltage to the charging roller 2M passes the primary transfer position N1M between the timing BT of applying a charging-assistant voltage at the first step and a timing BT2 of applying a charging-assistant voltage at the second step. Further, the potential of the photoconductive drum 1M after passing the primary transfer position N1M is about −300 V. In this case, it is possible to increase the transfer voltage more than when forming an image, for example, the transfer current may be set to 24 μA in order to keep the potential difference between the charging-assistant brush 7M and the photoconductive drum 1M. Therefore, the potential of the photoconductive drum 1 after passing the primary transfer position N1M is −200 V, such that it is possible to increase the potential difference between the charging-assistant brush 7M and the photoconductive drum 1M. Accordingly, it is preferable to make the positive toner difficult to transit from the charging-assistant brush 7M to the photoconductive drum 1M. That is, at the position of the photoreceptor that reaches the charging-assistant member while the charging-assistant voltage of the first step (first value) is applied, when the position that passed the charging portion where a voltage was applied passes the transfer portion, a voltage having a large absolute value with the same polarity as when forming an image can be applied to the transfer portion.

Similarly, even in the cyan image forming portion PC, the timing of applying a voltage to the charging roller 2C, unlike the control of the related art, is set as the optimal condition where unnecessary "distance between adjacent photoconductive drums"÷"process speed" is removed or as small as possible. The timing BT of applying a voltage to the charging-assistant brush 7C depends on that in the yellow image forming portion PY. Therefore, similar to the magenta image forming portion PM, the conditions A and B can be satisfied.

Next, the timing BT2 of switching the value of the charging-assistant voltage is described.

A voltage of −900 V is applied to the charging-assistant brushes 7Y, 7M, and 7C from the charging-assistant high-voltage power supply 8 to recharge the transfer residual toner after the timing BT2. The voltage is a voltage that is sufficiently discharged in the direction from the charging-assistant brush 7 to the photoconductive drum 1, even at the potential of −300 V of the photoconductive drum 1 after passing the primary transfer position N1.

The timing BT2 is a timing that is earlier than the time until an image starts to be formed in the yellow image forming portion PY and the transfer residual toner comes to the position of the charging-assistant brush 7Y, and is set to sufficiently discharge in the direction from the charging-assistant brush 7Y to the photoconductive drum 1. Accordingly, the transfer residual toner is sufficiently recharged and restoration to the developing sleeve 4Y is improved.

Further, the timing BT2 is set as follows for the cyan image forming portion PC that is the image forming portion at the lowermost-stream side in the image forming portions that share a power supply. That is, the timing BT2 is a timing of applying a voltage to the charging roller 2C, until the position of the photoconductive drum 1C, which passed the position of the charging-assistant brush 7C where a voltage was applied, comes to the charging roller 2C, in the cyan image forming portion PC (condition B).

As described above, the image forming apparatus 100 of the present embodiment includes a plurality of image forming portions along the movement direction of the transfer target member 90. The image forming portions PY, PM, and PC each include a rotatable photoreceptor 1, a charging portion 2 that charges the surface of the photoreceptor, an exposing unit 3 that forms an electrostatic image by exposing the charged photoreceptor, and a developing unit 14 that develops the electrostatic latent image formed on the photoreceptor using toner. Further, the image forming portions each include a transfer portion 9 that transfers the toner image formed on the photoreceptor to the transfer target member 90 and a charging-assistant member 7 that charges the toner on the photoreceptor at the downstream side of the transfer portion 9 and at the upstream side of the charging portion 2 in the rotational direction of the photoreceptor. The image forming portions each restore the toner charged with a normal charging polarity by the charging-assistant member 7 to the developing unit 14. Further, in the present embodiment, the image forming apparatus 100 further includes a common voltage-applying unit 8 that applies a voltage to the charging-assistant members 7 of the plurality of image forming portions PY, PM, and PC, and a control unit 110 that performs the following control when images are formed by the plurality of image forming portions PY, PM, and PC. That is, the control unit 110, in accordance with the start of applying a voltage to the charging-assistant members of the plurality of image forming portions by the voltage applying unit 8, switches the absolute value of the applied voltage from a smaller first value to a larger second value at a predetermined timing BT2.

In particular, a voltage starts to be applied to the charging portion 2 until the position of the photoreceptor that passed the charging-assistant member 7 after switching the voltage to the second value comes to the charging portion 2 in the image forming portion PC at the lowermost-stream side in the movement direction of the transfer target member in the plurality of image forming portions. Further, for the image forming portion PY at the uppermost-stream side in the same direction in the plurality of image forming portions, the value of the voltage applied by the voltage-applying unit 8 can be switched from the first value to the second value until the position where the exposure device on the photoreceptor starts to form an image arrives at the charging-assistant member.

As described above, by setting the value of the charging-assistant voltage in two steps, it is possible to remove or reduce the unnecessary charging time NT (sufficiently) as less as possible and to implement a timing of applying an appropriate voltage that satisfies the conditions A and B.

A general expression of the timing BT2 that satisfies the conditions is illustrated in FIG. 6.

In FIG. 6, n is the number of image forming portions that share the voltage-applying units that apply a voltage to the charging-assistant members. Further, r is the radius of the photoconductive drum. Further, B is the distance from the transfer position to the charging-assistant position in the rotational direction of the photoconductive drum. B of the n-th image forming portion is indicated by Bn (B1, B2, . . . ). Further, C is the distance from the transfer position to the charging position in the rotational direction of the photoconductive drum. C of the n-th image forming portion is indicated by Cn (C1, C2, . . . ). Further, L is the distance from the transfer position to the exposing position in the rotational direction of the photoconductive drum. L of the n-th image forming portion is indicated by Ln (L1, L2, . . . ). Further, K is the distance between adjacent image forming portions (distance between the centers of the photoconductive drums). Further, P is a process speed (circumferential velocity of the photoconductive drum). Further, x is an image exposure start time (image forming start time) and the charging-applying time at the uppermost-stream side is 0. The conditions of FIG. 6 are satisfied even in the present embodiment.

The left side of the expression illustrated in FIG. 6 represents that it is desirable that the charging-assistant brush 7 starts to discharge from the time when the charging voltage is turned on in the n-th image forming portion until the photoconductive drum 1 corresponding to the position passes the charging-assistant brush 7 in the n-th image forming portion. The time from the time when the charging voltage of the first image forming portion at the uppermost-stream side is turned on (made 0) until the charging voltage of the n-th image forming portion is turned on is expressed by $(n-1)K/P$. The time from turning-on of the charging voltage of the n-th image forming portion to the charging-assistant brush 7 in the n-th image forming portion is expressed by $(Cn-Bn)/P$. Therefore, the switching time BT2 of the charging-assistant brush 7 at the second step is necessary to be larger than $(n-1)K/P-(Cn-Bn)/P$.

On the other hand, the right side of the expression illustrated in FIG. 6 represents that it is desirable that the charging-assistant brush 7 starts to discharge until the transfer residual toner comes to the position of the charging-assistant brush 7 in the first image forming portion at the uppermost-stream side. The image forming start time in the first image forming portion at the uppermost-stream side is x. Further, the time taken until the formed image (transfer residual toner) reaches the charging-assistant brush 7 in the first image forming portion at the uppermost-stream side is $(2\pi r-L1+B1)/P$. Accordingly, the switching time BT2 of the charging-assistant brush 7 at the second step is necessary to be smaller than $x+(2\pi r-L1+B1)/P$.

As an example, the calculation result when the configuration of the present embodiment is applied to this formula is as follows. In the present embodiment, the left side is 1.58 and the right side is 1.83, for r=15 mm, B=30 mm, C=40 mm, L=45 mm, K=100 mm, P=120 mm/sec, and x=1.178 sec. Therefore, in the present embodiment, BT is 0.7 sec and BT2 is 1.7 sec.

5. Experiment for Ascertaining Effect of the Present Embodiment

Next, the result of an experiment for ascertaining the effect of the embodiment is described. The first examination condition was that there was unnecessarily increased charging time NT, as the control in the comparative example described above, as a comparative example. Further, the second examination condition was that the charging-assistant voltage was switched at the timing BT2 in the present embodiment. Further, the effect was ascertained by performing a durability test that forms images on two A4 paper sheets at an image ratio of 5% under each of the examination conditions, and comparing the number of sheets with an image until a poor image with longitudinal lines was found for each color. The result is shown in Table 1.

TABLE 1

| Image forming portion | Comparative example | Embodiment |
|---|---|---|
| PY | 38000 | 41000 |
| PM | 36000 | 40000 |
| PC | 26000 | 38000 |

In Table 1, a poor image was not generated till close to 38000 sheets in the yellow image forming portion PY of the comparative example. On the other hand, a poor image was not generated till close to 41000 sheets in the yellow image forming portion PY of the embodiment. This is because discharging of the charging-assistant brush 7Y was suppressed between BT and BT2 and fusion bonding of the toner on the photoconductive drum was reduced. The fusion bonding on the photoconductive drum means the state in which toner or powder generated by cutting by the photoconductive drum is fused and bonded to the photoconductive drum, thereby causing an image defect that interferes with formation of a favorable electrostatic latent image.

A poor image was not generated till close to 36000 sheets in the magenta image forming portion PM of the comparative example. On the other hand, a poor image was not generated till close to 40000 sheets in the magenta image forming portion PM of the embodiment. This is because, in the embodiment, as compared with the comparative example, the unnecessary charging-applying time NT decreased by about 10 percent, discharging of the charging-assistant brush 7M was suppressed between BT and BT2, and fusion bonding of the toner on the photoconductive drum was reduced.

A poor image was not generated till close to 26000 sheets in the cyan image forming portion PC of the comparative example. On the other hand, a poor image was not generated till close to 38000 sheets in the cyan image forming portion PC of the embodiment. This is because, in the embodiment, as compared with the comparative example, the unnecessary charging-applying time NT decreased by about 30 percent, discharging of the charging-assistant brush 7C was suppressed between BT and BT2, and fusion bonding of the toner on the photoconductive drum was reduced.

Further, since the image forming portion at the lowermost-stream side is also easily influenced by the retransfer residual toner, filming is easily generated in the toner. Therefore, it is seen that large reduction of the charging time NT in the embodiment is more effective.

When the high-voltage power supply 8 of the charging-assistant brushes 7 are shared by the four color image forming portions, the image forming portion at the lowermost-stream side is largely influenced by the toner filming. Therefore, the charging time NT that unnecessarily increased by "distance between photoconductive drums of image forming portions"÷"process speed" in the comparative example increases more. Since it is possible to greatly reduce the charging time when using the control of the present embodiment, the effect against filming increases.

As described above, it is possible to suppress generation of an image defect due to an increase of the time of applying a charging voltage in each image forming portion, even though the unit of applying a voltage to the charging-assistant members is shared in the plurality of image forming portions. Therefore, it is possible to reduce the space for the high-voltage power supplies, reduce the cost as compared with when individual high-power supplies are provided, prevent an image defect, and improve the durability life of the photoreceptor.

Further, in the embodiment described above, although the charging-assistant high-voltage power supply is shared by the image forming portions PY, PM, and PC, the invention is not limited thereto. The invention effectively operates, when at least two image forming portions are provided and at least two image forming portions share a charging-assistant high-voltage power supply.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-245895, filed Nov. 9, 2011, which is hereby incorporated by reference herein in its entirety.

What is claimed is:

1. An image forming apparatus comprising:

a first image forming portion and a second image forming portion, each including a rotatable photoreceptor, a charging device that charges a surface of the photoreceptor by contacting the photoreceptor with a charging portion, an exposure device that forms an electrostatic latent image on the surface of the photoreceptor by exposing the surface of the photoreceptor charged by the charging device, a developing device that forms a toner image on the surface of the photoreceptor by developing the electrostatic latent image formed on the surface of the photoreceptor by the exposing device using toner and restores transfer residual toner on the photoreceptor, a transfer device that transfers the toner image formed on the photoreceptor by the developing device to a transfer target member through a transfer portion, and a toner charging device that charges the toner on the photoreceptor by contacting the surface of the photoreceptor with a toner charging portion at a downstream side of the transfer portion and at an upstream side of the charging portion in a rotational direction of the photoreceptor, the first image forming portion and the second image forming portion being provided at positions such that a toner image of the second image forming portion overlaps and is transferred to the toner image transferred to the transfer target member from the first image forming portion;

a first charging power supply that applies a first charging voltage to the charging device provided in the first image forming portion;

a second charging power supply that applies a second charging voltage to the charging device provided in the second image forming portion;

a first transfer power supply that applies a first transfer voltage whose polarity is opposite to a normal charging polarity of the toner to the transfer device provided in the first image forming portion;

a second transfer power supply that applies a second transfer voltage whose polarity is opposite to the normal charging polarity of the toner to the transfer device provided in the second image forming portion;

a toner charging power supply that commonly applies a direct voltage, whose polarity is the same as the normal charging polarity of the toner, to the toner charging device provided in each of the first image forming portion and the second image forming portion; and a controller that starts applying a first direct voltage to the toner charging device provided in each of the first image forming portion and the second image forming portion from the toner charging power supply before a position on the photoreceptor which starts being charged reaches the toner charging portion after the first charging voltage starts being applied in the first image forming portion, and switches the direct voltage to be applied to the toner charging device provided in each of the first image forming portion and the second image forming portion from the toner charging power supply from the first direct voltage to a second direct voltage after the first direct voltage starts being applied and before a position on the photoreceptor where the exposure device starts forming an electrostatic latent image reaches the toner charging portion, in the first image forming portion, wherein the first direct voltage is such a direct voltage that an electric field between the toner charging device and the photoreceptor is an electric field in a direction in which the toner charged with the polarity opposite to the normal polarity of the toner does not move from the toner charging device to the photoreceptor, and discharging does not occur between the toner charging device and the photoreceptor, the second direct voltage is a such a direct voltage that discharging occurs between the toner charging device and the photoreceptor, and a timing of starting applying the second charging voltage in the second image forming portion comes after a timing of starting applying the first charging voltage in the first image forming portion, and comes before a timing of switching the direct voltage to be applied to the toner charging device, from the first direct voltage to the second direct voltage.

2. The image forming apparatus according to claim 1, the controller controls the first transfer power supply and the second transfer power supply such that the first transfer voltage and the second transfer voltage to be applied to the transfer device while an area on the photoreceptor which passes the toner charging device to which the first direct voltage is applied in the first image forming portion and the second image forming portion passes the transfer portion are greater than the first transfer voltage and the second transfer voltage to be applied when the toner image is transferred to the transfer target member.

* * * * *